US011203480B2

(12) United States Patent
Zhang

(10) Patent No.: US 11,203,480 B2
(45) Date of Patent: Dec. 21, 2021

(54) INSTANT MIXING CONTAINER AND PRODUCT

(71) Applicant: Guangming Zhang, Shandong (CN)

(72) Inventor: Guangming Zhang, Shandong (CN)

(73) Assignee: Guangming Zhang, Zibo (CN)

( * ) Notice: Subject to any disclaimer, the term of this patent is extended or adjusted under 35 U.S.C. 154(b) by 0 days.

(21) Appl. No.: 16/012,812

(22) Filed: Jun. 20, 2018

(65) Prior Publication Data

US 2018/0297769 A1 Oct. 18, 2018

Related U.S. Application Data

(63) Continuation of application No. PCT/CN2016/110286, filed on Dec. 16, 2016.

(30) Foreign Application Priority Data

Dec. 21, 2015 (CN) ..... 201510959662.6
Jul. 19, 2016 (CN) ..... 201610568179.X

(51) Int. Cl.
*B65D 81/32* (2006.01)
*B65D 1/06* (2006.01)
*B65D 85/72* (2006.01)

(52) U.S. Cl.
CPC ..... *B65D 81/3222* (2013.01); *B65D 1/06* (2013.01); *B65D 85/72* (2013.01); *B65D 2203/00* (2013.01)

(58) Field of Classification Search
CPC ..... B65D 81/3222; B65D 1/06; B65D 85/72; B65D 2203/00; B65D 49/12; B65D 81/3216; B65D 51/243
(Continued)

(56) References Cited

U.S. PATENT DOCUMENTS 2,714,974 A * 8/1955 Sawyer ..... B65D 81/3272 222/94
3,199,437 A * 8/1965 Nelsen ..... A47J 31/02 99/317
(Continued)

FOREIGN PATENT DOCUMENTS

CN 103043314 A 4/2013
CN 203568175 U 4/2014
(Continued)

OTHER PUBLICATIONS

First Office Action in Chinese Application No. 201610568412.4 dated Nov. 28, 2017, 16 pages.

*Primary Examiner* — J. Gregory Pickett
*Assistant Examiner* — Jenine Pagan
(74) *Attorney, Agent, or Firm* — Metis IP LLC

(57) ABSTRACT

Disclosed are an instant mixing container. The container includes a main container and an inner container fitted inside the main container. A mutually isolated outer storage chamber and inner storage chamber are provided inside the main container and the inner container respectively. An opening is provided on the inner container, and when the opening is pressed, impacted or pulled by an external force and opens, the outer storage chamber and the inner storage chamber are in communication. The container can instantly mix two or more materials, several different materials are respectively filled to constitute an integrally formed product, and the container is convenient to use, is able to keep the materials for a long time, and has an anti-counterfeiting function.

11 Claims, 8 Drawing Sheets

(58) Field of Classification Search
USPC ..... 206/221; 215/DIG. 8
See application file for complete search history.

(56) References Cited

U.S. PATENT DOCUMENTS

| | | | | |
|---|---|---|---|---|
| 3,342,324 | A | 9/1967 | Piazze | |
| 3,429,429 | A | 2/1969 | Poitras | |
| 3,718,235 | A * | 2/1973 | Cronan | B65D 83/687 222/136 |
| 4,893,730 | A * | 1/1990 | Bolduc | B65D 81/3222 169/83 |
| 6,021,892 | A | 2/2000 | Baudin | |
| 6,036,005 | A * | 3/2000 | Krause | B65D 35/242 206/221 |
| 6,517,878 | B2 * | 2/2003 | Heczko | A23L 2/00 206/219 |
| 7,866,465 | B2 * | 1/2011 | Dverin | B65D 25/085 206/219 |
| 7,900,769 | B1 * | 3/2011 | Chen | B65D 81/3272 206/219 |
| 2006/0113201 | A1 * | 6/2006 | Micic | B65D 81/3211 206/221 |
| 2006/0213788 | A1 | 9/2006 | Juneau | |
| 2009/0014449 | A1 * | 1/2009 | Dverin | B65D 81/3222 220/501 |
| 2009/0152296 | A1 | 6/2009 | May | |
| 2009/0178940 | A1 * | 7/2009 | Said | A61J 9/00 206/221 |
| 2013/0037506 | A1 * | 2/2013 | Wahlstrom | A61J 1/2093 215/6 |
| 2015/0360844 | A1 * | 12/2015 | Frieden | B65D 81/3211 206/222 |
| 2018/0020851 | A1 * | 1/2018 | Joebges | A47G 19/2222 206/221 |

FOREIGN PATENT DOCUMENTS

| | | | |
|---|---|---|---|
| CN | 104340540 | A | 2/2015 |
| CN | 104627458 | A | 5/2015 |
| CN | 105438665 | A | 3/2016 |
| CN | 205891685 | U | 1/2017 |
| FR | 1248882 | A | 12/1960 |
| FR | 2345363 | A1 | 10/1977 |
| GB | 2099391 | A | 12/1982 |
| JP | 2000-126218 | A | 5/2000 |

* cited by examiner

INSTANT MIXING CONTAINER AND PRODUCT

TECHNICAL FIELD

The present invention relates to instant mixing container and product, belonging to the technical field of containers.

BACKGROUND ART

In the field of separated and sealed preservation, quality guaranteeing, freshness retaining, rot prevention, storage and transportation of various products and product materials formed by the packaging containers and filling and packaging materials of drink, pharmaceutical and biological products, to separately package the component materials of some mixed-type products of drinks and pharmaceuticals, etc. enables the physicochemical properties of the solvent and the physicochemical properties of the solute to be kept in a relatively stable state, so as to effectively reduce the use amount of the preservatives. Therefore, the method of packaging and sealing solutes and solvents separately is used for the preservation, quality guaranteeing, rot prevention, storage and transportation of materials and products, and when a user intends to use or consume the materials and products, the solutes and the solvents are mixed instantly according to needs. For example, the patent document with the publication number CN104340540A discloses an instant liquid mixing beverage bottle, which is a result of unremitting efforts by those skilled in the art. However, although this effectively solves some of the related problems, it still has various defects and practical problems difficult to solve. In such a prior art technical solution of beverages and products, a sealed storage silo is provided on the bottle cap for storing a solute, a solvent is stored in the bottle, and a user needs to open the storage silo by means of an opening device to mix the solute with the solvent in the bottle. However, such configuration and method are achieved by filling and sealing a single solute material in one production place or on a separate production line, and then transferring the same to another place or another production line and combining the same with a bottle filled with the solvent, which sometimes even requires the process of manual assembly. Such configuration and method that need to be achieved by performing separated production first and then combination can hardly be achieved on an automatic assembly line in a single high-cleanness and high-standard closed place meeting the sanitary requirements, can hardly prevent secondary pollution in the transfer process or in the combining process, and also can hardly prevent the problems that, for example, the quality is difficult to control due to the factors such as excessively complicated production process and excessive procedures of structural combination between the containers. For the concept, structure and configuration of most of these existing technical inventions, considerations are given between an individual container and another individual container or between an individual bottle and a sealing unit device thereof, they each can only be filled with or contain a single solute or solvent, and then combined, after being sealed, by being placed side by side, being stacked or being spirally fixed, and especially at the time of serving and mixing for use, the containers are opened for mixing, which is not only inconvenient, but also difficult to prevent the entrance of air, making it difficult to prevent pollution. Moreover, the total number of the types of the solute and solvent materials that can be combined and mixed instantly can hardly exceed two, and the materials are generally limited to two types of materials, i.e., liquid solute and liquid solvent, powder solute and liquid solvent, particulate solute and liquid solvent, solid solute and liquid solvent, etc., or limited to relatively monotonous combination products of materials in two states. Once there are more than two states and/or more than two types of materials, it is impossible to separately package, seal and then combine the materials to form an integral combination product, not to mention achieving and implementing instant mixing of two or more different materials within a sealed unit under the conditions of being isolated from air, preventing pollution, not destroying the integral packaging and/or being sealed, or meeting various practical requirements of people for product diversity, individuation and customization according to different people and requirements. Furthermore, the existing containers have various defects and problems that need to be solved, for example, they are easy to recycle and repaired for counterfeiting.

BRIEF DESCRIPTION OF THE INVENTION

The technical problem to be solved by the present invention is: overcoming the defects in the prior art and providing an instant mixing container and product capable of instantly mixing two or more materials, in which several different materials are separately filled and then combined to form an integral set of product, which is convenient to use, is able to preserve the materials for a long time, and has an anti-counterfeiting function of one-time opening and being difficult to repair for reuse.

The technical solution employed by the present invention for the solution of the technical problem thereof is: an instant mixing container, comprising a main container and a secondary container, wherein the inner chamber of the main container is a main storage chamber, the secondary container is disposed inside the main container, the inner chamber of the secondary container is a secondary storage chamber, an openable aperture is provided on the secondary container, the openable aperture is opened after being pressed, impacted or pulled by an external force to make the main storage chamber and the secondary storage chamber communicate with each other or make two adjacent secondary storage chambers communicate with each other, a wall of the main container is at least partially a deformable opening movable part, a deformable reverse movable part is further provided on the wall of the main container, the opening movable part deforms to directly or indirectly make contact with and open the openable aperture, and the deformation direction of the reverse movable part is opposite to that of the opening movable part.

According to the instant mixing container of the present invention, several different materials such as solvents and solutes can be separately filled in the main container and the secondary container to form an integral nested-type product, various materials and products can be preserved, quality-guaranteed, rot-prevented, stored and transported in a separated, sealed and nested manner, the openable aperture of the secondary container can be opened through the opening movable part without opening the main container, different materials contained in a nested manner can be instantly mixed in the internal pollution-free environment to obtain a mixture product, the container is convenient to use and can preserve the materials for a long time. What's more, in the present invention, the reverse movable part can provide a deformation space for the main container, because materials are stored in the main storage chamber, if there is no reverse deformation at the time of deformation of the opening movable part, it will be difficult for the opening movable part to deform, thereby making it difficult to open the openable aperture, and even impossible to make contact with the openable aperture. For the above reasons, a reverse movable part is designed in the present invention to provide corresponding reverse deformation for the main container at the time of deformation of the opening movable part, so that the opening movable part can make contact with the openable aperture directly and smoothly or make contact with the openable aperture through other components. Moreover, since the openable aperture is opened only after being pressed, impacted or pulled by an external force, it is difficult to repair the openable aperture, which endows the container with the one-time opening and anti-counterfeiting function.

Preferably, the secondary container includes a plurality of inner container units, the inner chamber of each inner container unit is a secondary storage chamber, the secondary storage chambers are isolated from each other, and each inner container unit is provided with an openable aperture. The wall of the main container is preferably an elastic material with an expansion-retraction deformable function, so as to facilitate the formation of the opening movable part and the reverse movable part, or the opening movable part is provided at least on a side wall of the main container and the reverse movable part is provided at the bottom of the main container. In this way, when the opening movable part on the wall or the side wall of the main container is pressed or pulled, the reverse movable part can help to provide a reverse deformation space the main storage chamber needs due to the deformation of the opening movable part on the side wall. Of course, because of the presence of the reverse deformation space, it is possible that the openable aperture on the secondary container can burst open from the inside when the container is heated through microwaves.

Preferably, the plurality of inner container units is sequentially connected, a partition plate is provided between the upper and lower adjacent inner container units, an opening part and a sealing unit for sealing the opening part are provided at the upper side of the partition plate and of the uppermost inner container unit, and the diameter of any opening part is larger than the diameter of the sealing unit of the inner container unit below the opening part.

Preferably, a filtering mechanism is further provided in the main storage chamber, and the opening is located below the filtering mechanism.

Preferably, a reinforcing rib is provided on the wall of the main container, and/or a connection skeleton is provided between the main container and the secondary container.

An inner concave part is provided on the side wall of the main container, and the opening movable part is provided on the inner concave part. The inner concave part can effectively prevent undesirable opening of the opening resulting from unintended touch on the opening movable part.

Preferably, an inner container skeleton is provided at an upper end of the secondary container, an upper end of the inner container skeleton extends out of the upper opening of the main container and the main container sealing unit, and an inner container skeleton external sealing unit is hermetically connected to the upper end opening of the inner container skeleton.

Preferably, an opening part and a sealing unit for sealing the opening part are provided at the upper side of the partition plate and of the main container, and the diameter of any opening part is larger than the diameter of the sealing unit of the secondary storage chamber below the opening part.

In the present invention, it is feasible to dispose inside the main container a plurality of secondary containers which are sequentially disposed in a nested manner. However, there can also be many other methods for connecting the main container with the secondary containers. It should be appreciated by those skilled in the art that the structure of the present invention necessarily goes beyond these limited connection modes described above, and some equivalent substitution solutions or common means are still covered by the protection scope of the present application.

In order to ensure that the weak such as children can open the opening successfully, an opening connecting rod is provided between the opening movable part and the opening in the present invention. The opening connecting rod makes it easier to make contact with the openable aperture, and enables repeated pressing against the openable aperture by repeatedly pressing the opening movable part, so as to finally open the openable aperture, which has high operability and is especially suitable for the weak such as children.

As a further improvement of the present invention, an opening pull ring is further provided on an outer side of the opening movable part, the two ends of the opening connecting rod are connected with the opening pull ring and the openable aperture, respectively, and the openable aperture can be opened more easily by pulling outwards the opening movable part through the opening pull ring to repeatedly pressing the openable aperture.

Preferably, the openable aperture is provided on the wall of the secondary container, and a connecting edge between the openable aperture and the wall of the secondary container comprises a weak connecting edge and a firm connecting edge. When the openable aperture is pressed, impacted or pulled by an external force, the weak connecting edge is broken, and the firm connecting edge still connects the openable aperture with the wall of the secondary container. Of course, this is merely one of the options. It is also feasible to provide the openable aperture on the partition plate, or even set the sealing unit to be the openable aperture that is opened after being pressed, impacted or pulled by an external force.

On the basis of the instant mixing container, the present invention further provides an instant mixing product, comprising the above described instant mixing container, in which different materials are stored in the main storage chamber and the secondary storage chamber. A plurality of different materials of solvents and solutes or a plurality of different combinations thereof are separately filled in the main container and the secondary container to form a plurality of integral nested-type products, various materials and products are preserved, quality-guaranteed, rot-prevented, stored and transported in a separated, sealed and nested manner, and different materials contained in a nested manner can be instantly mixed in the internal pollution-free environment to obtain different mixture products. The product is convenient to use, can preserve the materials for a long time, does not need preservatives or reduces the use of preservatives to the maximum extent, and is more hygienic.

Filling can be performed in accordance with different materials. The main storage chamber and/or the secondary storage chamber are also filled with one or a mixture of ozone, carbon dioxide and an inert gas. In addition, beneficial bacteria or active enzymes are further added to the materials in the main storage chamber and/or the secondary storage chamber. The beneficial bacteria are beneficial bacteria such as bifidobacteria, lactobacilli and *Eurotium cristatum*. The materials such as enzymes can further be added, so as to achieve or enhance the comprehensive effects or enhance the comprehensive freshness-retaining and rot-prevention functions.

Further, the present invention also provides a filling method for the above described instant mixing product, comprising sequentially filling and sealing the secondary storage chambers, and finally filling and sealing the main storage chamber, wherein a material is filled and then sealed in the innermost or bottommost secondary container, then a different material is filled and then sealed in the most adjacent secondary container that is closer to the outer side than the aforesaid secondary container or situated on the aforesaid secondary container, this process proceeds sequentially until a further different material is filled and then sealed in the main container, then an integral product in which the materials are contained in a nested-manner is obtained, wherein the different materials do not make contact with each other to pollute each other, leading to better freshness-retaining and quality-guaranteeing effects and longer preservation time.

Preferably, the secondary container comprises a plurality of inner container units that are sequentially connected in a vertical direction, the inner chamber of each inner container unit is a secondary storage chamber, and the secondary storage chambers are isolated from each other. A partition plate is disposed between adjacent inner container units, an opening part and a sealing unit for sealing the opening part are provided at the upper side of the partition plate and of the uppermost inner container unit, the diameter of any opening part is larger than the diameter of the sealing unit of the inner container unit below or inside the opening part, and the diameter of the opening part of the main container is larger than the diameter of the sealing unit of the uppermost or largest opening part of the inner container or the secondary container. The center points of all the opening parts are arranged on a single vertical line, the secondary storage chambers are sequentially filled with different materials from bottom to top or from inside to outside by using a nozzle, each secondary storage chamber is sealed by using a mechanical arm immediately after it has been filled with the material, the sealing unit is fixed at the opening part, and the main container is filled and sealed at last.

The method of mixing by using the above-mentioned instant mixing container achieves communication between the main storage chamber and the secondary storage chamber and mixing of different materials without opening the main container, by opening the openable aperture of the secondary container through the elastic expansion-retraction wall or the opening movable part, and can especially achieve mixing without being polluted by foreign materials so as to obtain various mixture products. Of course, it is also possible to achieve communication between the main storage chamber and the secondary storage chamber and mixing of different materials in the case where the main container is opened, so as to obtain various mixture products.

Compared with the prior art, the present invention has the following advantageous effects:

1. A plurality of different materials of solvents and solutes can be separately filled in the main container and the secondary container to form an integral nested-type product, various materials and products are preserved, quality-guaranteed, rot-prevented, stored and transported in a separated, sealed and nested manner, the materials in the main container and the secondary container of the present invention can be mixed in an environment completely isolated from the outside, the material mixing process is not polluted by any foreign materials, and different materials contained in a nested manner can be instantly mixed in the internal pollution-free environment to obtain mixture products. The present invention is particularly suitable for mixing materials under the conditions of radiation, in the wild, or in case of emergency so as to obtain the desired products, which is convenient to use and can preserve the materials for a long time. Moreover, since the opening is opened or bursts open after being pressed, impacted or pulled by an external force or after being heated to expand, the container is difficult to repair and therefore has one-time opening and anti-counterfeiting functions. In addition, the present invention does not require the addition of any preservative and is more hygienic.

Some of the pure or single-substance raw materials or materials among the components of the existing products such as pharmaceuticals, traditional Chinese medicine that is served as tea, and drinks are very sensitive or active, and in order to prevent the occurrence of rotting and reaction, it is a general practice to use the method of adding preservatives, etc. for freshness retaining, quality guaranteeing, rot prevention and preservation. However, the damages caused by the addition of preservatives and the resultant diseases caused thereby are increased explosively. After having suffered a great deal from preservatives, people are well aware of this. For the sake of health, people have to try to avoid the use of harmful substances such as preservatives, then it is necessary to sterilize, disinfect, process and treat the curative and nutritious beneficial materials that are sensitive, active, and susceptible to pollution, reaction and rot, especially two or more different solute materials that need to be mixed for use and/or need to be used in one or more combinations, then contain the same in a separated and sealed manner, and finally combine the same with solvent materials to form an integral nested-type product, thereby preventing the materials from mixing, pollution, reaction and rot, and ensuring the formation of nested-type products that can mix the materials for use and is convenient to use. Moreover, effective quality-guaranteeing, rot-prevention and preservation of the materials can be achieved in a relatively long specified time limit, and the requirement of large-batch automatic production has to be met. These requirements cannot be met by the existing technical inventions. Therefore, there is a need for an innovative multi-functional and multi-chamber container that can meet the above requirements and can contain several kinds of materials in a sealed and nested manner. This container can realize cooperative, coordinated and orderly production with various materials and production equipment on the automatic production lines in a highly clean and standard closed place, and can realize washing, sterilization, filling and disinfection, and enable containing of at least one single-substance material in different storage chambers in a separated and sealed manner to realize quality-guaranteeing, rot-prevention and preservation, and placing of the same in a larger integral multi-chamber and multifunctional container in a nested manner, forming a novel integral nested-type product filled with different materials. During the process from production, shipment to reaching the user, whether the container is normally used in ordinary conditions or used in emergencies under special environments and conditions, e.g., in disaster areas with epidemic diseases in which rescue and relief work need to be done, in the wild with sand flying in the air or with the smoke of gunpowder, or in rocking vehicles, ships, aircraft carriers, submarines, airplanes or the like, the container shall meet the requirements of instantly and uniformly mixing the prepared different materials in the internal and closed condition and environment of the novel multi-chamber nested-type container without any leakage, without entrance of air and with no bacteria and dust pollution, in a quality and hygiene guaranteeing, safe and controllable, efficient, simple, convenient, selective, direct and rapid fashion, so as to obtain nutritious, energy, functional and curative mixture products such as pharmaceuticals, traditional Chinese medicine that is served as tea, and drinks especially for emergency use in saving life or sustaining life. Further, it should be noted that the container shall have anti-counterfeiting function for preventing the container from being recycled and repaired by lawbreakers for reuse. The present invention can address the above issues very well.

2. Different openable apertures of the multiple inner container units can be opened according to needs, making it possible to instantly mix various materials contained in a nested manner and obtain various mixture products.

3. The diameter of any opening part is larger than the diameter of the sealing unit of the inner container unit below the opening part. It is feasible to install the sealing units on the opening parts one by one by means of an automatic assembly line, and sequentially install the sealing units through the opening parts from bottom to top by means of a mechanical arm, to realize, one by one from inside to outside, blowing-injection, cleaning, sterilization, filling, disinfection, preservation, and sealing of each inner container unit and the opening part with a sealing unit, and realize cooperation of the various procedures and coordinated and orderly production, so as to obtain nested-type products filled with or containing at least two kinds of materials in a nested manner.

4. An opening connecting rod is provided between the opening movable part and the opening, and the opening is opened by means of the opening connecting rod, which is more convenient in operation, does not require particularly great deformation of the main container, and therefore reduces the requirements on the main container.

5. In the solution in which the storage chamber of the main container is constituted by a wall that is elastic, multiple configurations of the secondary containers can be obtained through combination, which are suitable for use under various conditions.

Figure 1:
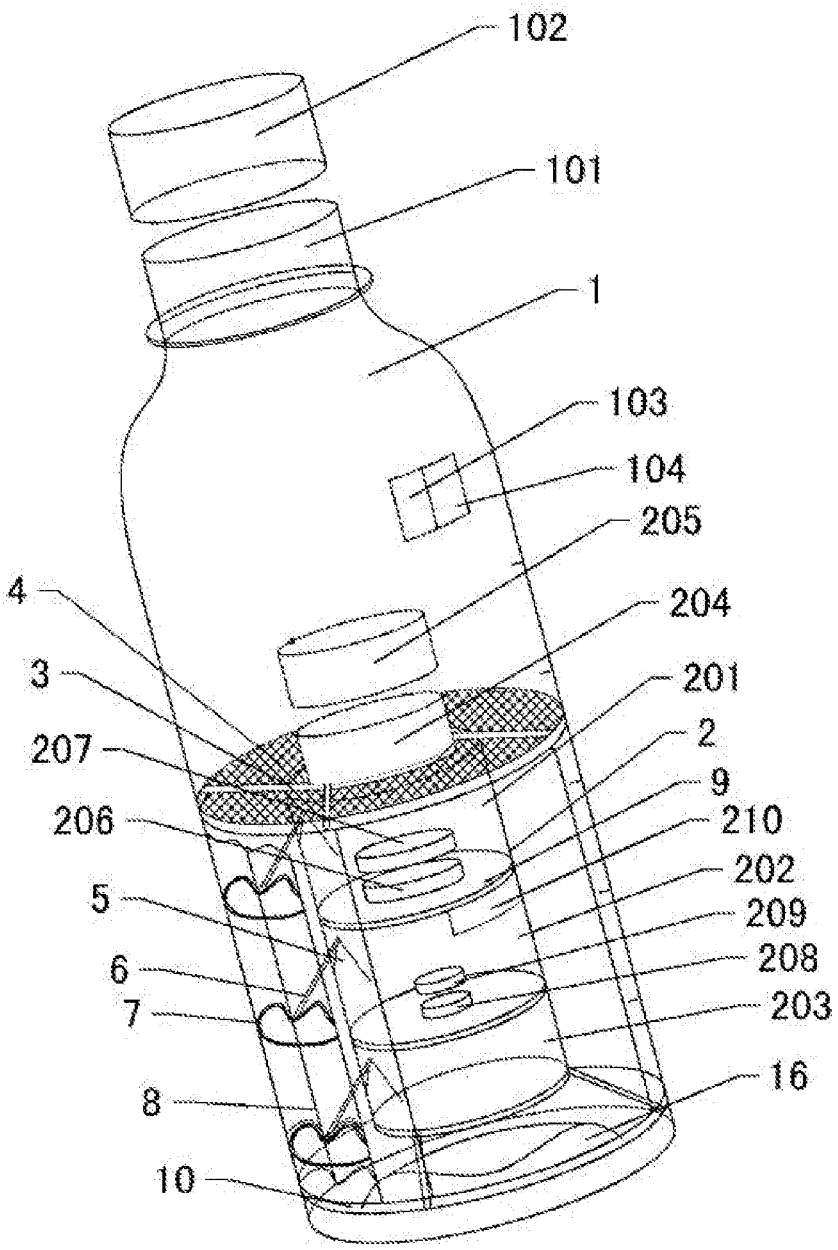
FIG. 1 is a schematic structural diagram of embodiment 1 of the instant mixing container.
Figure 2:
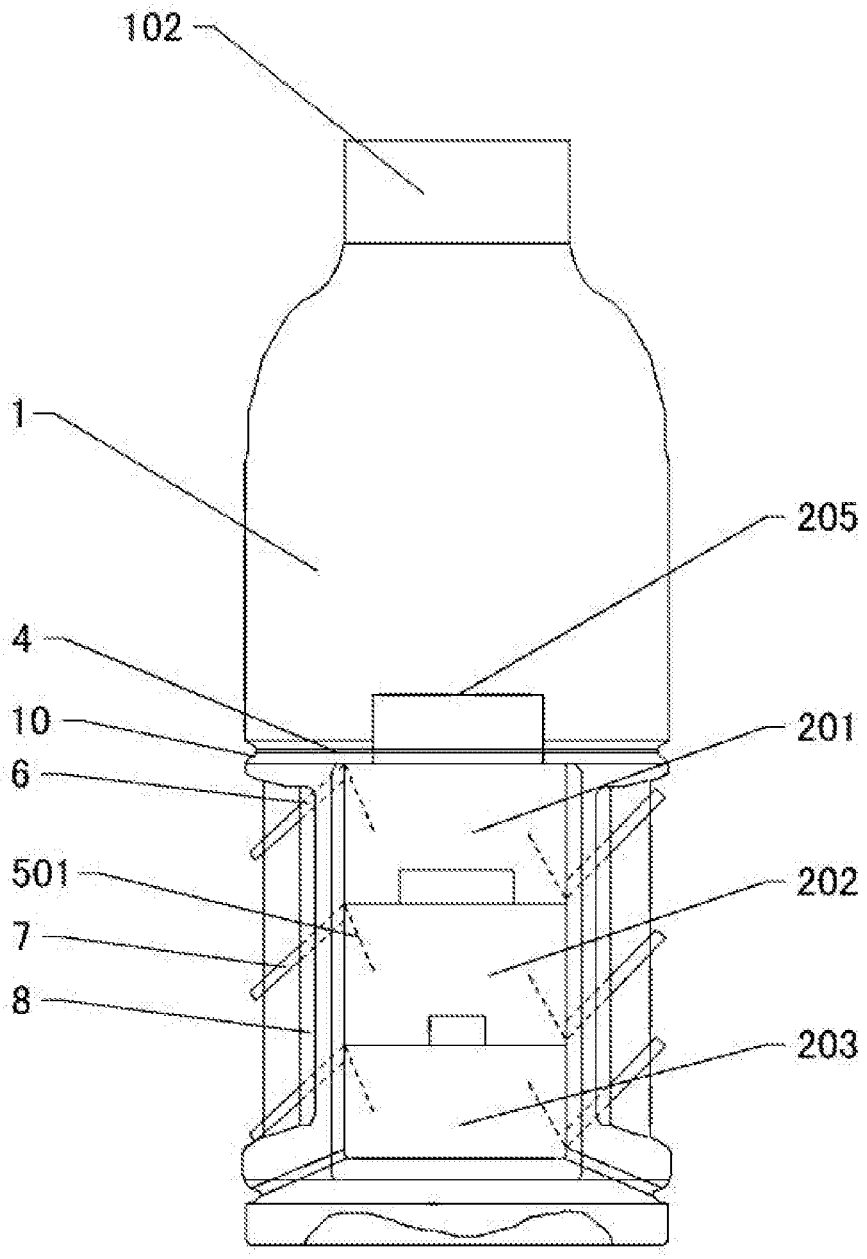
FIG. 2 is a front view of the instant mixing container in embodiment 1.
Figure 3:
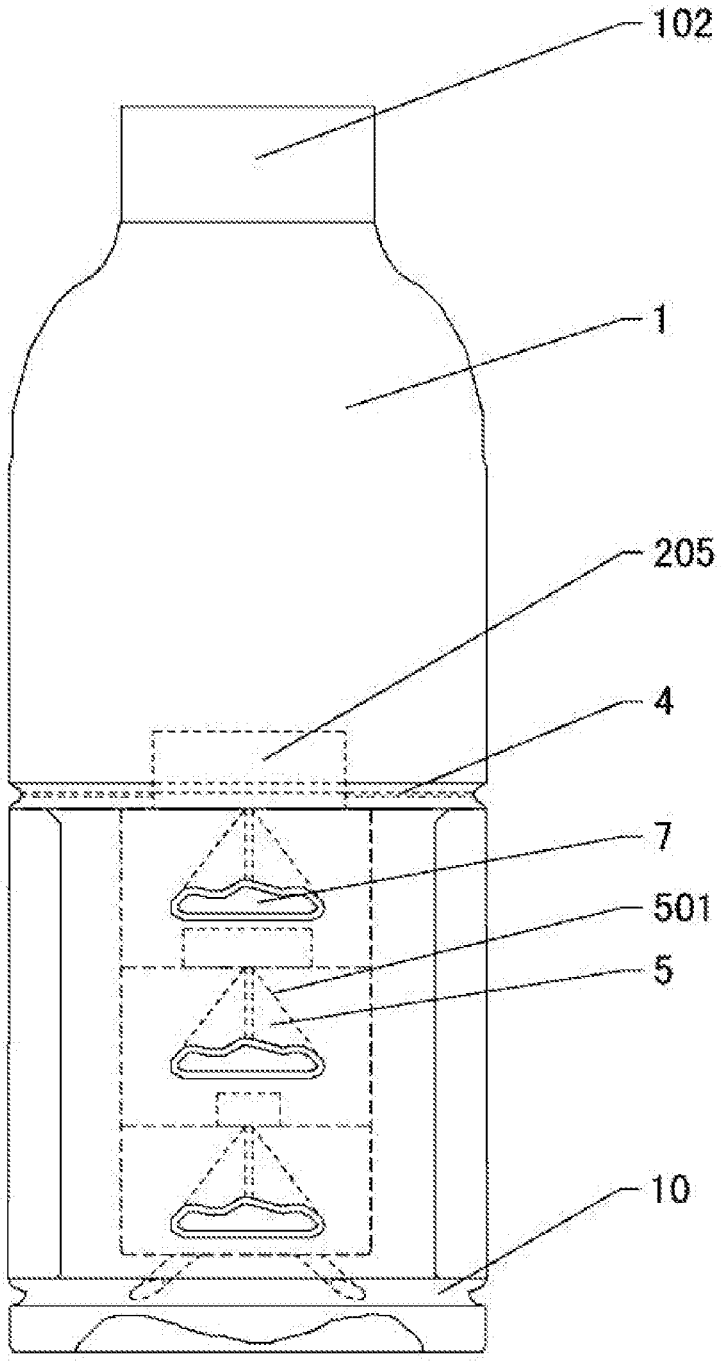
FIG. 3 is a left view of the instant mixing container in embodiment 1.
Figure 4:
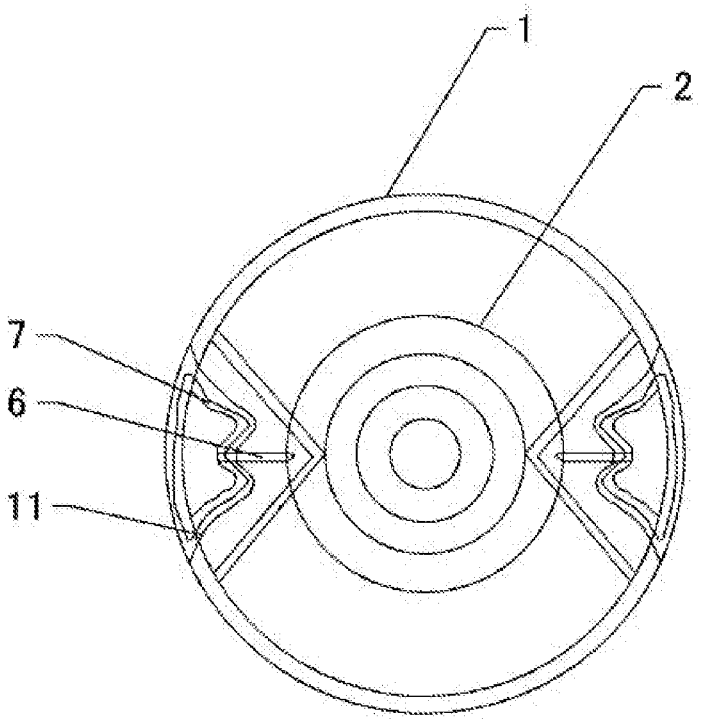
FIG. 4 is a top view of the instant mixing container in embodiment 1.

In the drawings: 1. main container; 101. main container opening part; 102. main container sealing unit; 103. main container graphic-text area; 104. security code area; 2. secondary container; 201. first inner container; 202. second inner container; 203. third inner container; 204. first inner container opening part; 205. first inner container sealing unit; 206. second inner container opening part; 207. second inner container sealing unit; 208. third inner container opening part; 209. third inner container sealing unit; 210. inner container graphic-text description area; 3. connection skeleton; 4. filter screen; 5. openable aperture; 501. weak connecting edge; 6. opening connecting rod; 7. opening pull ring; 8. opening movable part; 9. partition plate; 10. reinforcing rib; 11. inner concave part; 12. inner container skeleton; 13. inner container external opening part; 14. inner container skeleton external sealing unit; 15. conical wall; and 16. reverse movable part.

EMBODIMENTS OF THE INVENTION

Detailed Description of Embodiments

FIGS. 1-4 are the optimal embodiments of the instant mixing container and product. The present invention is further described below with reference to FIGS. 1-8.

Referring to FIG. 1, the instant mixing container comprises a main container 1 and a secondary container 2, the inner chamber of the main container 1 is a main storage chamber, the secondary container 2 is disposed inside the main container 1, the inner chamber of the secondary container 2 is a secondary storage chamber, an openable aperture 5 is provided on the secondary container 2, the openable aperture 5 is opened after being pressed, impacted or pulled by an external force to make the main storage chamber and the secondary storage chamber communicate with each other or make two adjacent secondary storage chambers communicate with each other, the side wall of the main container 1 is provided with a deformable opening movable part 8, a deformable reverse movable part 16 is further provided on the wall of the main container 1, the opening movable part 8 deforms to directly or indirectly make contact with and open the openable aperture 5, and the deformation direction of the reverse movable part 16 is opposite to that of the opening movable part 8. The reverse movable part 16 provides corresponding reverse deformation for the main container 1 when the opening movable part 8 deforms, so that the opening movable part 8 smoothly and directly makes contact with the openable aperture 5 or makes contact with the openable aperture 5 through another component. The upper part of the main container 1 is provided with a main container opening part 101 and is connected with a main container sealing unit 102. In the present invention, several different materials of solvents and solutes can be separately filled in the main container 1 and the secondary container 2 to form an integral nested-type product, various materials and products can be preserved, quality-guaranteed, rot-prevented, stored and transported in a separated, sealed and nested manner, different materials contained in a nested manner can be instantly mixed in the internal pollution-free environment to obtain different mixture products. The container is convenient to use and can preserve the materials for a long time. Moreover, since the openable aperture 5 is opened only after being pressed, impacted or pulled by an external force, it is difficult to repair the openable aperture, which endows the container with the one-time opening and anti-counterfeiting function. The sealing unit in the present invention can be a cap, a screwed plug, a nut or a snap cap, and even can be a hot-melt sealing part.

The present invention is further described below in connection with specific embodiments. However, it should be understood by those skilled in the art that the detailed description given herein with reference to the drawings merely serves for better explanation, the structure of the present invention necessarily exceeds these limited embodiments, and as to some equivalent substitution solutions or common means, no detailed description is made herein, but they are still covered by the protection scope of the present application.

Referring to FIGS. 1-4, in the present embodiment, the secondary container 2 comprises a plurality of inner container units that are disposed in the main storage chamber and sequentially connected in a vertical direction, the inner chamber of each inner container unit is a secondary storage chamber, and the secondary storage chambers are isolated from each other. The inner container units specifically include a first inner container 201, a second inner container 202 and a third inner container 203. Each inner container unit is provided with an openable aperture 5. The plurality of inner container units is arranged to have a vertically series-connected, nested-type configuration, and different openable apertures 5 can be opened according to needs so as to instantly mix the various materials contained in a nested manner and obtain various mixture products. Different numbers of main storage chambers can be provided according to needs, and in the present embodiment, description is made with the case where there is one main storage chamber.

In the present embodiment, a partition plate 9 is provided between adjacent inner container units, two inner container units are connected through the partition plate 9, an opening part and a sealing unit for sealing the opening part are provided at the upper side of the partition plate 9 and of the uppermost inner container unit, and the diameter of any opening part is larger than the diameter of the sealing unit of the inner container unit below the opening part. It is feasible to install the sealing units on the opening parts one by one by means of an automatic assembly line, and sequentially install the sealing units through the opening parts from bottom to top by means of a mechanical arm, to realize, one by one from inside to outside, blowing-injection, cleaning, sterilization, filling, disinfection, preservation, and sealing of each inner container unit and the opening part with a sealing unit, and realize cooperation of the various procedures and coordinated and orderly production, so as to obtain nested-type products filled with or containing at least two kinds of materials in a nested manner. Specifically, in the present embodiment, a first inner container opening part 204 is provided in the upper portion of the first inner container 201, the first inner container opening part 204 is provided with a first inner container sealing unit 205, a second inner container opening part 206 is provided on the upper side of the second inner container 202, the second inner container opening part 206 is provided with a second inner container sealing unit 207, a third inner container opening part 208 is provided on the upper side of the third inner container 203, the third inner container opening part 208 is provided with a third inner container sealing unit 209, the diameter of the second inner container sealing unit 207 is smaller than that of the first inner container opening part 204, the diameter of the third inner container sealing unit 209 is smaller than that of the second inner container opening part 206, and the diameter of the first inner container sealing unit 205 is smaller than that of the main container opening part 101. In this way, it is possible to use a mechanical arm to sequentially pass the third inner container sealing unit 209, the second inner container sealing unit 207 and the first inner container sealing unit 205 through the opening parts and fix the same to the corresponding opening parts. In the present embodiment, a main container graphic-text area 103 and a security code area 104 are provided on the outer side of the main container 1, and an inner container graphic-text description area 210 is provided on the outer side of the secondary container 2. On the opening movable portion 8 is provided an opening icon or a massage contact, and by selectively exerting an external force on the opening icons or the massage contacts, the corresponding openable apertures can be opened accurately, thereby achieving the configuration and function of selectively making the corresponding sealed secondary storage chambers communicate with one another according to needs to instantly mix various different materials, and autonomous, successive and instant mixing of various different materials contained in the inner containers and/or the units of an inner container combination in a nested manner, which makes it possible to select to obtain at least one and/or successively obtain two or more mixture products.

As a further improvement, in the present embodiment, a filtering mechanism is further provided in the main storage chamber, and the openable aperture 5 is located below the filtering mechanism. After being mixed, the materials in the main storage chamber and in the secondary storage chamber have to go through the filtering mechanism first in order to go upwards to reach the upper opening of the main container 1, which prevents particulate articles from being drunk, leading to safer use.

Preferably, a reinforcing rib 10 is provided on the wall of the main container 1, or a connection skeleton 3 is provided between the main container 1 and the secondary container 2. Of course, it is also feasible to provide a connection skeleton 3 between the main container 1 and the secondary container 2, while providing a reinforcing rib 10 on the wall of the main container 1. Specifically, in the present embodiment, the connection skeleton 3 is provided in the outer storage chamber between the upper part of the uppermost inner container unit and the main container 1, the filtering mechanism comprises a filter screen 4 provided at the hollow part of the connection skeleton 3, and at the same time, the connection skeleton 3 serves to fix and support the inner container.

Further, in the present embodiment, an opening connecting rod 6 is provided between the opening movable part 8 and the openable aperture 5, an opening pull ring 7 is further provided on the outer side of the opening movable part 8, and the two ends of the opening connecting rod 6 are connected with the opening pull ring 7 and the openable aperture 5, respectively. It may be impossible for the weak such as children to break the openable aperture 5 by directly pressing the opening movable part 8 to cause it to deform. The opening connecting rod 6 will make it easier to open the openable aperture 5. Moreover, it is feasible to form repeated pressing against the openable aperture 5 by repeatedly pressing the opening movable part 8 and pulling outwards the opening movable part 8 by the opening pull ring 7 at the same time, so as to finally open the openable aperture 5, which is more operable and is especially suitable for the weak such as children.

The openable aperture 5 is provided in the side wall of the secondary container 2, and the connecting edge between the openable aperture 5 and the side wall of the secondary container 2 comprises a weak connecting edge 501 and a firm connecting edge. When the openable aperture 5 is pressed, impacted or pulled by an external force, the weak connecting edge 501 is broken, and the firm connecting edge still connects the openable aperture 5 with the side wall of the inner container. Specifically, the weak connecting edge 501 can be obtained by the following methods, i.e., 1. a part of the wall of the openable aperture 5 is made to have a thickness smaller than the thickness of the surrounding inner container side wall, so that the weak connecting edge 501 is formed between the openable aperture 5 and the inner container side wall, and another part of the wall of the openable aperture 5 is made to have a thickness equal to or even greater than the thickness of the surrounding inner container side wall, so that the firm connecting edge is formed between the openable aperture 5 and the inner container side wall; and 2. the openable aperture 5 is connected with the inner container side wall in a manner of tear line so as to form the weak connecting edge 501, and the openable aperture 5 is not wholly connected with the inner container side wall in the manner of tear line, then the part of the openable aperture 5 that is normally connected with the inner container side wall forms the firm connecting edge. The openable aperture 5 in the present embodiment assumes the shape of triangle as shown in the drawings, the two upper sides of the triangle are connected with the inner container side wall in the manner of tear line, thereby forming the weak connecting edge 501, and the lower part of the openable aperture 5 is not connected with the inner container side wall in the manner of tear line, forming the firm connecting edge. The openable aperture 5 moves in a reciprocating mode with the firm connecting edge as the shaft after it is opened, which facilitates large-area and efficient mixing of the materials, and also prevents the openable aperture 5 from falling off. Of course, the openable aperture 5 in the present embodiment can be totally formed by the weak connecting edge 501.

Filling of various materials which have been disinfected, processed and treated is performed separately from inside to outside through the opening parts, the opening part of the innermost container unit which is filled with materials first is fitted with a sealing unit first, sealing of the inner container units is performed one by one from inside to outside in such a manner that once an inner container unit is filled, it is immediately sealed, and all the inner container units are successively filled with the materials and then sealed at the opening parts from inside to outside to form an integral closed inner container, in which the solute and solvent materials are contained in a separated and sealed manner. Moreover, the main container 1 is filled with the solvent or solute material and is sealed, and at the same time contains the inner container in a sealed manner, thereby achieving preservation, quality-guaranteeing, rot-prevention, storage and transportation of two or more materials contained in a nested manner, and forming an integral nested-type product for preservation and rot-prevention of two or more materials.

One or more pairs of opening movable parts 8 are provided on the wall of the main container 1, under the action of an external force, the opening movable part 8 is concaved and/or bulges to deform and displace, and an opening icon or a massage contact is provided on the opening movable part 8. In the present embodiment, the opening movable part 8 is arranged to have a configuration of being appropriately concaved relative to the outline or shape of the entire main container 1 and closer to the inner container. A reinforcing rib 10 is provided on the wall of the main container 1, and/or a connection skeleton 3 is provided between the inner container and the main container 1, which can reduce the probability of collision and the occurrence of mixing operation by mistake, and provides protection while facilitating opening. As a further improvement, in the present embodiment, inner concave parts 11 are further provided on the side wall of the main container 1, the inner concave parts 11 are symmetrically arranged on the two sides of the main container 1, the opening movable part 8 is disposed in the middle of the inner concave part 11, so that the openable aperture 5 can be effectively prevented from being opened by mistake, leading to higher reliability.

In the present embodiment, a reverse movable part 16 is disposed at the bottom of the main container 1, and correspondingly, a reinforcing rib 10 is also provided at the bottom of the main container 1, above the reverse movable part 16.

Embodiment 2

Figure 5:
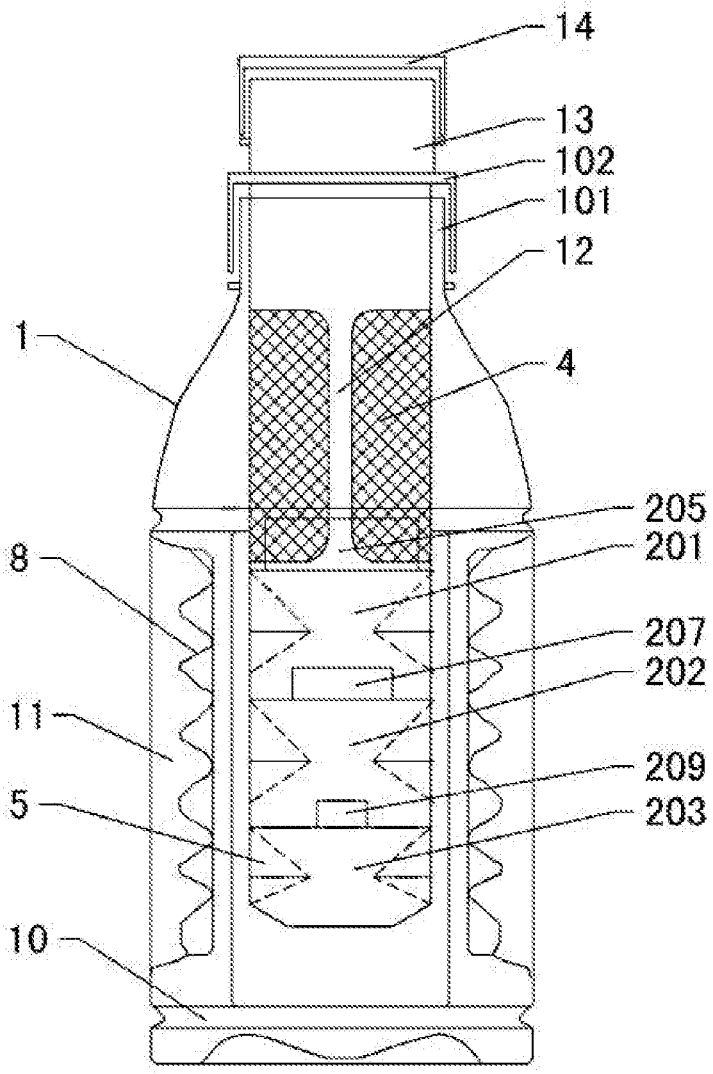
FIG. 5 is a schematic structural diagram of embodiment 2 of the instant mixing container.
Figure 6:
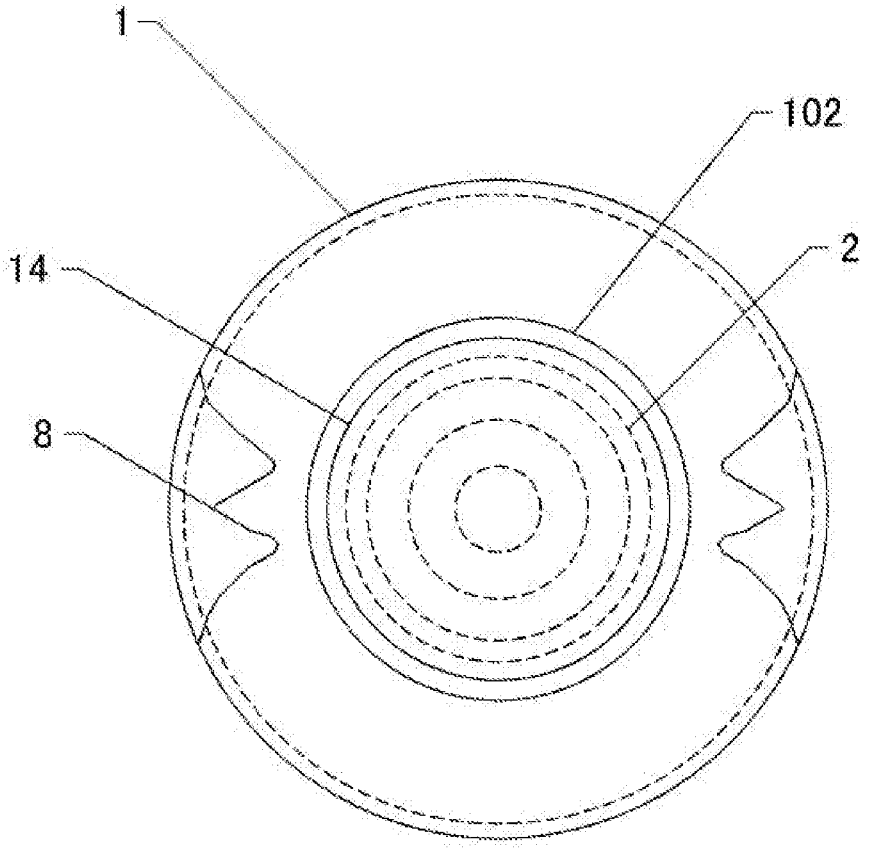
FIG. 6 is a top view of the instant mixing container in embodiment 2.

Referring to FIGS. 5 and 6, in the present embodiment, an inner container skeleton 12 is provided at the upper end of the secondary container 2, the upper end of the inner container skeleton 12 extends out of the upper opening of the main container 1 and the main container sealing unit 102, the container sealing unit 102 of the main container 1 is in threaded connection or in hot-melt connection with the upper part of the inner container skeleton 12, the upper end part of the inner container skeleton 12 that extends out of the container sealing unit 102 of the main container 1 is provided with an inner container external opening part 13 and is connected with an inner container skeleton external sealing unit 14, and the inner container skeleton external sealing unit 14 and the main container sealing unit 102 jointly form a seal for the main storage chamber. A filter screen 4 is provided on the inner container skeleton 12, and after the openable aperture 5 of the inner container is opened by means of the opening movable part 8, the materials in the main storage chamber and in the secondary storage chamber are mixed, and the mixture reaches the inner container external opening part 13 after passing through the filter screen 4.

Embodiment 3

Figure 7:
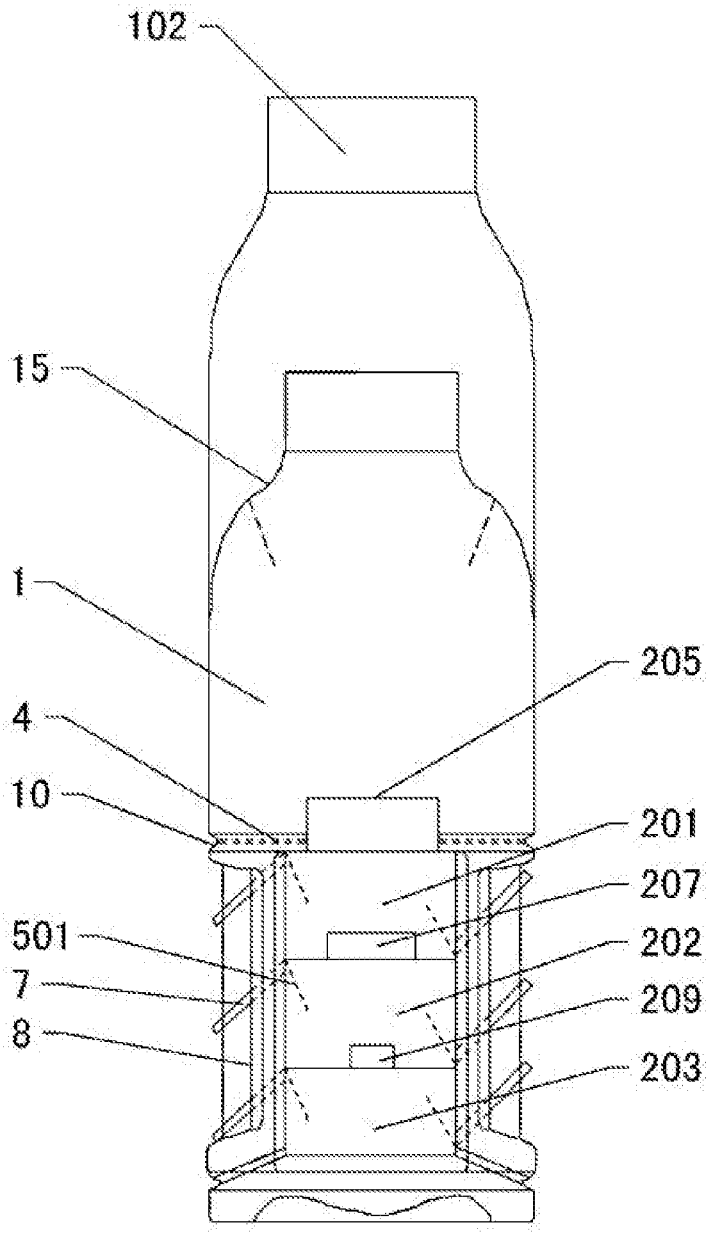
FIG. 7 is a schematic structural diagram of embodiment 3 of the instant mixing container.

Referring to FIG. 7, in the present embodiment, there can be several main containers 1 connected in the vertical direction, a lower main container 1 extends upwards into an upper main container 1, the lower main container 1 is also provided with an openable aperture 5, the openable aperture 5 is provided on the upper conical wall 15 of the corresponding main container 1, the secondary container 2 comprises a first inner container 201, a second inner container 202 and a third inner container 203 disposed in the lower main container 1, and each inner container unit is provided with an openable aperture 5. Different openable apertures 5 can be opened according to needs, so that more kinds of mixture products can be obtained.

A partition plate 9 is disposed between adjacent inner container units, two inner container units are connected through the partition plate 9, an opening part and a sealing unit for sealing the opening part are provided at the upper side of the partition plate and of the uppermost inner container unit, and the diameter of any opening part is larger than the diameter of the sealing unit of the secondary storage chamber below the opening part. A main container sealing unit 102 is provided. Filling of the third inner container 203, the second inner container 202 and the first inner container 201 is sequentially performed by using a nozzle, and correspondingly, the third inner container sealing unit 209, the second inner container sealing unit 207, the first inner container sealing unit 205 and the main container sealing unit 102 are sequentially fixed to the corresponding opening parts by using a mechanical arm. The operation of the mechanical arm can be varied, e.g., 1. an mechanical arm capable of transversely stretching and retracting or swinging can be used to clamp the sealing units with different diameters and screw the same onto the corresponding opening parts; and 2. a protruding part or a multi-edge groove facilitating the clamping of a mechanical arm can be formed on the upper side of the sealing unit, and the mechanical arm clamps the protruding part or clamps the multi-edge groove, and passes a sealing unit through the opening parts and screws the sealing unit onto the corresponding opening part. In the present embodiment, the openable aperture 5 can also be provided on the sealing unit of the secondary container unit.

Embodiment 4

Figure 8:
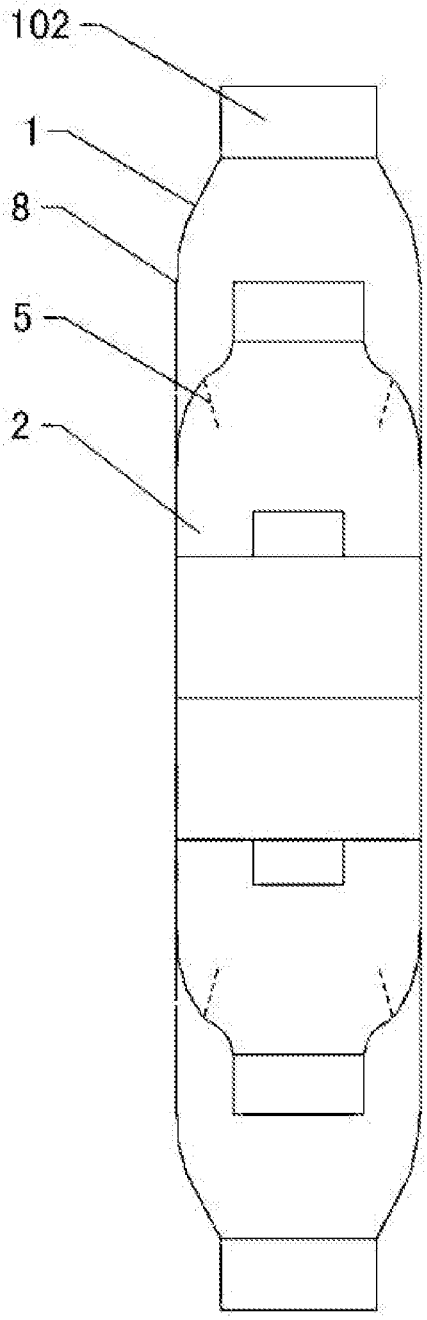
FIG. 8 is a schematic structural diagram of embodiment 4 of the instant mixing container.

Referring to FIG. 8, in the present embodiment, both ends of the main container 1 are provided with a main container opening part 101 which is sealed by a main container sealing unit 102, and multiple secondary containers 2 are arranged in the main storage chamber. Thus, it is possible to obtain different products by opening the openable apertures 5 of different secondary containers 2. Moreover, a different product can be drunk or used through the main container opening part 101 on a different one of the two sides of the main container 1.

The present invention further provides an instant mixing product, comprising the above described instant mixing container, in which different materials are stored in the main storage chamber and the secondary storage chamber. Various solvent and solute materials in different states that have been sterilized, disinfected and/or processed and treated are separately filled in the main container 1 and the secondary container 2, wherein the solvent is a liquid or other fluid or semi-fluid material, and the solute is a single-substance material that is in liquid, solid, powder, particle, paste, juice or other fluid or semi-fluid state, may include natural plant, or original and natural parts of animals and processed products thereof, and may have different therapeutic effects, functions, nutrition, effects, tastes and colors. Two or more compatible raw materials are first combined and then sealed, optionally together with appropriate and compatible beneficial materials, in various different units in the nested-type container, to form various nested-type products including the combination of the above-mentioned liquid, solid, powder, particle, paste and juice. Moreover, by means of the configuration and the function of the nested-type container, it is possible to realize selecting, adding, reducing or changing various different solutes according to different people and different needs and combine the solute with one or more solvents to form various customized nested-type products. Further, according to actual needs, the user can recognize, check, make a general observation of, and evaluate the outer and inner conditions of the nested-type product and the conditions before, during and after instant mixing, through the inner and outer transparent, anti-counterfeiting observation windows provided on the inner and outer container unit bodies, or through the transparent wall of the storage chamber, graphics-text description and markers, and make comparisons and select to first mix at least one single-material solute with one solvent to obtain at least one mixture product for use, and then select to mix other kinds of materials to obtain mixture products with other therapeutic effects, functions or tastes, and nested-type products of materials in various states and having different functions and/or in various different combinations.

By means of the above described instant mixing container, it is possible to contain at least two kinds of materials in a separated, sealed and nested manner. Sterilizing, disinfecting and/or preservative and rot-preventing ozone, carbon dioxide, inert gases, and/or beneficial substances of the kind of beneficial bacteria, together with the appropriate and desired materials, are introduced or blow-injected into the chambers of the unit bodies which have been filled with at least one single-substance material of solute or solvent that has been disinfected and/or processed and treated. The chambers are filled one by one from inside to outside in such a manner that once a chamber is filled, it is immediately sealed, until all the storage chamber unit bodies are isolated from one another and sealed, and form an integral body with a container in a nested manner. Appropriate and desired beneficial substances are added to and sealed with at least one single-substance material in a separate storage chamber unit body, then the storage chamber unit body is placed in a container in a nested manner to form an integral body, thereby realizing sealed, isolated and nested-type configuration, layout, function and pattern of a nested-type product for preservation, quality-guaranteeing, freshness-retaining and rot-prevention, and forming materials contained in a nested manner and a nested-type product with the functions of preservation, quality-guaranteeing and rot-prevention.

With regard to the main container 1 and the secondary container 2, various suitable materials with stable physical and chemical properties can be selected, and various suitable structures or architectures that can be made into a wall or a film or a combination of wall and film can be adopted. A transparent observation anti-counterfeiting window, graphics-text description, a graduated scale and markers are provided at a position convenient for observation on the main container 1 and the secondary container 2.

The present invention further provides a filling method for the above described instant mixing product, comprising sequentially filling and sealing the secondary storage chambers, and finally filling and sealing the main storage chamber. The secondary container 2 comprises a plurality of inner container units that are disposed in the main storage chamber and sequentially connected in a vertical direction, the inner chamber of each inner container unit is a secondary storage chamber, and the secondary storage chambers are isolated from each other. A partition plate 9 is disposed between adjacent inner container units, an opening part and a sealing unit for sealing the opening part are provided at the upper side of the partition plate 9 and of the uppermost inner container unit, and the diameter of any opening part is larger than the diameter of the sealing unit of the inner container unit below the opening part. The secondary storage chambers are sequentially filled from bottom to top, and the sealing units are fixed to the opening parts by a mechanical arm, until the main container 1 is sealed, which realizes automatic production, and reduces contact to prevent the occurrence of pollution. The mechanical arm can adopt the above described structure.

The instant mixing container can be used in the industry of drinks, and can also be used in the medical industry, especially in emergency situations, as anti-inflammatory and first-aid medicine and other medicine are filled in the secondary container 2 and then are sealed in the main container 1, when in use, the opening movable part 8 of the main container 1 is pressed so as to open the openable aperture 5 of the secondary container 2 to achieve mixing under the conditions of being completely isolated from the outside, which ensures hygiene of the medicine. Of course, the present invention can be applied to various industries, and no further description is made herein.

The above description is merely preferred embodiments of the present invention, which are not intended to limit the present invention otherwise. Any person skilled in the art may change or modify the above disclosed technical contents to obtain equivalent embodiments. However, any simple changes, equivalent variations and modifications made to the above embodiments according to the technical substance of the present invention without departing from the contents of the technical solutions of the present invention are still covered by the protection scope of the technical solutions of the present invention.

What is claimed is:

1. An instant mixing container, comprising a main container and at least one secondary container, wherein the least one secondary container includes a first inner container, and a second inner container, wherein the first inner container and the second inner container are sealed and positioned in the main container, wherein the wall of the main container is an elastic material with an expansion-retraction deformable function;

wherein the main container comprises a main storage chamber, and the first inner container and the second inner container each comprises a secondary storage chamber;

an opening movable part is provided on a sidewall of the main container, and two openable apertures are provided, each on a sidewall of each of the first inner container and the second inner container;

the opening movable part is configured to be deformable; and when an external force is applied to the opening movable part, the opening movable part is deformed toward the openable aperture on the sidewall of the first inner container and the side wall of the second inner container to open the openable apertures, so as to communicate the main storage chamber with the secondary storage chambers and communicate respective secondary storage chambers of the first inner container and the second inner container; and wherein, the first inner container is positioned on top of the second inner container and adjacent to the second inner container;

the first inner container includes a first inner container opening part between the secondary storage chamber of the first inner container and the main storage chamber, the first inner container opening part being sealed by a first inner container sealing unit;

the second inner container includes a second inner container opening part between the secondary storage chamber of the second inner container and the secondary storage chamber of the first inner container, the second opening part being sealed by a second inner container sealing unit;

a diameter of the first inner container opening part is larger than a diameter of the second inner container sealing unit, allowing filling and sealing the second inner container, the first inner container, and the main container in sequence without mixing.

2. The instant mixing container according to claim 1, wherein when there are more than two secondary storage chambers, each of the secondary storage chambers is isolated from each other and each of the secondary storage chambers corresponds to at least one openable aperture and at least one of the opening movable part.

3. The instant mixing container according to claim 2, wherein the first inner container and the second inner container are fixed in position relative to the main container; a partition is provided between the main container, first inner container and the second inner container to isolate the storage chambers.

4. The instant mixing container according to claim 1, wherein a filtering mechanism is fixedly provided in the main storage chamber; and the openable aperture is located at a side of the filtering mechanism remote from the opening of the main container.

5. The instant mixing container according to claim 1, wherein a reinforcing rib is provided on the wall of the main container, and/or a connection skeleton is provided between the main container and the first inner container and the second inner container; the connecting skeleton is configured to fix a position of the first inner container and the second inner container relative to the main container.

6. The instant mixing container according to claim 1, wherein an inner concave part is provided on the side wall of the main container; and the opening movable part is arranged on the inner concave part.

7. The instant mixing container according to claim 1, wherein an inner container skeleton is provided at an upper end of the first inner container; an upper end of the inner container skeleton extends out of the opening of the main container and a main container sealing unit, and an external sealing unit for the inner container skeleton is hermetically connected to the opening of the inner container skeleton.

8. The instant mixing container according to claim 1, wherein an opening connecting rod is provided between the opening movable part and the openable aperture.

9. The instant mixing container according to claim 8, wherein an opening pull ring is further provided on an outer side of the opening movable part, and the two ends of the opening connecting rod are connected with the opening pull ring and the openable aperture, respectively.

10. An instant mixing product, characterized by comprising the instant mixing container according to claim 1, wherein different materials are separately stored in the main storage chamber and the secondary storage chambers.

11. The instant mixing product according to claim 10, wherein the main storage chamber and/or one of the secondary storage chambers further contain ozone, carbon dioxide or an inert gas.

* * * * *